US012735877B2

(12) United States Patent
Tan

(10) Patent No.: US 12,735,877 B2
(45) Date of Patent: Sep. 15, 2026

(54) ANTI-WINDING PULL-OUT SENSOR FAUCET

(71) Applicant: Xin Tan, Chongqing (CN)

(72) Inventor: Xin Tan, Chongqing (CN)

( * ) Notice: Subject to any disclaimer, the term of this patent is extended or adjusted under 35 U.S.C. 154(b) by 138 days.

(21) Appl. No.: 18/759,019

(22) Filed: Jun. 28, 2024

(65) Prior Publication Data

US 2026/0002347 A1 Jan. 1, 2026

(51) Int. Cl.
*E03C 1/04* (2006.01)

(52) U.S. Cl.
CPC ..... *E03C 1/0405* (2013.01); *E03C 1/0403* (2013.01); *E03C 2001/0415* (2013.01); *Y10T 137/9464* (2015.04)

(58) Field of Classification Search
CPC .... E03C 1/0401; E03C 1/0403; E03C 1/0404; E03C 1/0405; E03C 2001/0415; Y10T 137/9464
USPC ..... 137/801
See application file for complete search history.

(56) References Cited

U.S. PATENT DOCUMENTS 7,748,406 B2 * 7/2010 Pilatowicz ..... E03C 1/08 239/443
9,695,580 B2 * 7/2017 Esche ..... F16K 37/0041
9,758,951 B2 * 9/2017 Evans ..... E03C 1/057
10,081,931 B2 * 9/2018 Song ..... F16K 27/0263
10,227,759 B2 * 3/2019 Li ..... G01R 33/07
12,043,995 B2 * 7/2024 Liao ..... E03C 1/057
2006/0202142 A1 * 9/2006 Marty ..... E03C 1/055 251/129.04
2007/0040380 A1 * 2/2007 Benstead ..... E03C 1/0404 285/321
2012/0160349 A1 * 6/2012 Jonte ..... E03C 1/05 137/551
2013/0248033 A1 * 9/2013 Parikh ..... E03C 1/0401 137/801
2022/0235537 A1 * 7/2022 Li ..... E03C 1/0404

* cited by examiner

*Primary Examiner* — Daphne M Barry

(57) ABSTRACT

The invention discloses an anti-winding pull-out sensor faucet, comprising a main body, a plastic connection joint and a swinging elbow pipe; plastic connection joint is threadedly connected to upper end of main body, swinging elbow pipe is in plug-in connection with plastic connection joint, pipe separator is in plug-in connection with upper end of plastic connection joint, port of swinging elbow pipe is in plug-in connection with pull-out sprayer cartridge, and pull-out sprayer cartridge is in plug-in connection with hand sprayer; one end of hand sprayer within pull-out sprayer cartridge is connected to pull-out hose, and other end of pull-out hose is set throughout pipe separator along inner wall of swinging elbow pipe; in swinging elbow pipe is a wire clamp, which is in plug-in connection with inductor limiter, inductor limiter is in plug-in connection with an inductor, and upper end of inductor is set through swinging elbow pipe.

5 Claims, 3 Drawing Sheets

ANTI-WINDING PULL-OUT SENSOR FAUCET

1. TECHNICAL FIELD

The invention belongs to the technical field of sensor faucet, specifically relates to an anti-winding pull-out sensor faucet.

2. BACKGROUND ART

Pull-out sensor faucet, just as its name implies, is a faucet whose pipe connected to an outlet of the faucet can be drawn out, and there is a sensor can control water outlet when hands are in the sensing area of faucet, which can be used more conveniently and flexibly; however, the existing faucet sensing device can only be installed on a lower part of the main body of the faucet, which makes the existing sensor faucet easy to mistakenly trigger, at the same time, the inductor and wiring harness connected to the inductor is also set in the faucet elbow pipe, and the pull-out hose is prone to be entangled with the wiring harness and affect the use when in the pull-out use. For this reason, we put forward an anti-winding pull-out sensor faucet to solve the above problem.

3. SUMMARY OF THE INVENTION

Targeting at above situation, in order to solve the technical problem, the invention provides an anti-winding pull-out sensor faucet, which effectively solved the problem of easy to be mistakenly triggered in existing pull-out sensor faucet, and solved problem of the pull-out hose prone to be entangled with the wiring harness of inductor.

The technical scheme provided by the invention is an anti-winding pull-out sensor faucet, comprising a main body, a plastic connection joint and a swinging elbow pipe; the plastic connection joint is threadedly connected to an upper end of the main body, the swinging elbow pipe is in plug-in connection with the plastic connection joint and is provided above the main body, a pipe separator is provided in plug-in connection with an upper end of the plastic connection joint, a port of the swinging elbow pipe is in plug-in connection with a pull-out sprayer cartridge, and the pull-out sprayer cartridge is in plug-in connection with a hand sprayer; one end of the hand sprayer located within the pull-out sprayer cartridge is connected to a pull-out hose, and an other end of the pull-out hose is set throughout the pipe separator along an inner wall of the swinging elbow pipe; in the swinging elbow pipe is provided with a wire clamp and the wire clamp is provided above the pull-out hose; the wire clamp is in plug-in connection with an inductor limiter, the inductor limiter is in plug-in connection with an inductor, and an upper end of the inductor is set through the swinging elbow pipe, an other end of the inductor passes over a top of the wire clamp and between an inner wall of the swinging elbow pipe and is set running through the pipe separator.

As an improvement of the scheme, the plastic connection joint is in plug-in connection with anti-swing snap rings, side wall of the plastic connection joint is sleeved with O-rings, and the wire clamp is set in grooves on side wall of the pipe separator between two sets of anti-swing snap rings, a side wall of the plastic connection joint is provided with a plurality of wavelike projections, the side wall of the plastic connection joint is in plug-in connection with a limiting snap ring, and the limiting snap ring is snap-fitted with the projections on the side wall of the plastic connection joint; a swinging snap ring is snap-fitted with side wall at a rear end of the plastic connection joint.

As an improvement of the scheme, a valve core seat is provided at an outlet at a side end of the main body, the outlet at the side end of the main body is in plug-in connection with a valve core, and the valve core is aligned and connected with the valve core seat; the outlet at the side end of the main body is threadedly connected with a gland, and the gland is threadedly connected with a decorative cover; the decorative cover is rotatably connected with a handle, and a control end on the valve core is in plug-in connection with the handle.

As an improvement of the scheme, a bottom of the main body is in plug-in connection with a foundation ring, the bottom of the main body is threadedly connected with a double-ended screw tube, and the double-ended screw tube is set through the foundation ring.

As an improvement of the scheme, the pipe separator and wire clamp are both set between the pull-out hose and the inductor, the swinging snap ring is set between the plastic connection joint and an inner wall of the swinging elbow pipe, and the inductor limiter is set between the wire clamp and the inner wall of the swinging elbow pipe.

As an improvement of the scheme, the anti-swinging snap ring is set in a C-shape, the pipe separator is set in a U-shaped piece with two curved sides, and the swinging snap ring is set in a curved plate shape.

In specific use, the pull-out hose and wiring harness of inductor are separated via the wire clamp and pipe separator fixed in the swinging elbow pipe, and at the same time, the inductor is assembled with the wire clamp via the inductor limiter and are fixed in the pull-out sprayer cartridge, and the inductor's induction window fixedly passes through an upper end of the pull-out sprayer cartridge; the inductor is utilized for inductively controlling a switch of the water flow, and the wire clamp is used to guide the pull-out hose and the wiring harness of inductor when it is needed to pull the hand sprayer, and to keep the two being separated, to prevent them from winding together, the above is the entire using process of the anti-winding pull-out sensor faucet.

Compared with the prior art, the invention has the following advantages:

1. The pull-out hose and the wiring harness will not be entangled together via the structure of separating the pull-out hose and the wiring harnesses of inductor, and arrangement of the wire clamp in the elbow pipe ensures the pull-out function of the faucet in use;
2. The inductor is set on a top of the elbow pipe by setting the inductor in the swinging elbow pipe, so that it can effectively reduce the situation of mistaken touch.

4. BRIEF DESCRIPTION OF ACCOMPANY DRAWINGS

As shown in the accompanying drawings: 1 hand sprayer, 2 pull-out sprayer cartridge, 3 swinging elbow pipe, 4 inductor, 5 inductor limiter, 6 wire clamp, 7 pull-out hose, 8 anti-swing snap ring, 9 O-ring, 10 limiting snap ring, 11 swinging snap ring, 12 pipe separator, 13 plastic connection joint, 14 main body, 15 valve core seat, 16 valve core, 17 gland, 18 decorative cover, 19 handle, 20 foundation ring, 21 double-ended screw tube.

The accompanying drawings are used to provide a further understanding of the invention and form part of the specification, are used in conjunction with embodiments of the invention for the purpose of explaining the invention and do not constitute a limitation of the present invention.

5. SPECIFIC EMBODIMENT OF THE INVENTION

The technical scheme of the invention is further described clearly and detailedly hereinafter with reference to the drawings. Obviously, only partial embodiments of the invention are shown and the actual structure is not limited thereto. All other embodiments, which can be obtained by those skilled in the art without making any creative effort based on the embodiments in the present invention, shall all fall within the protective scope of the invention.

Figure 1:
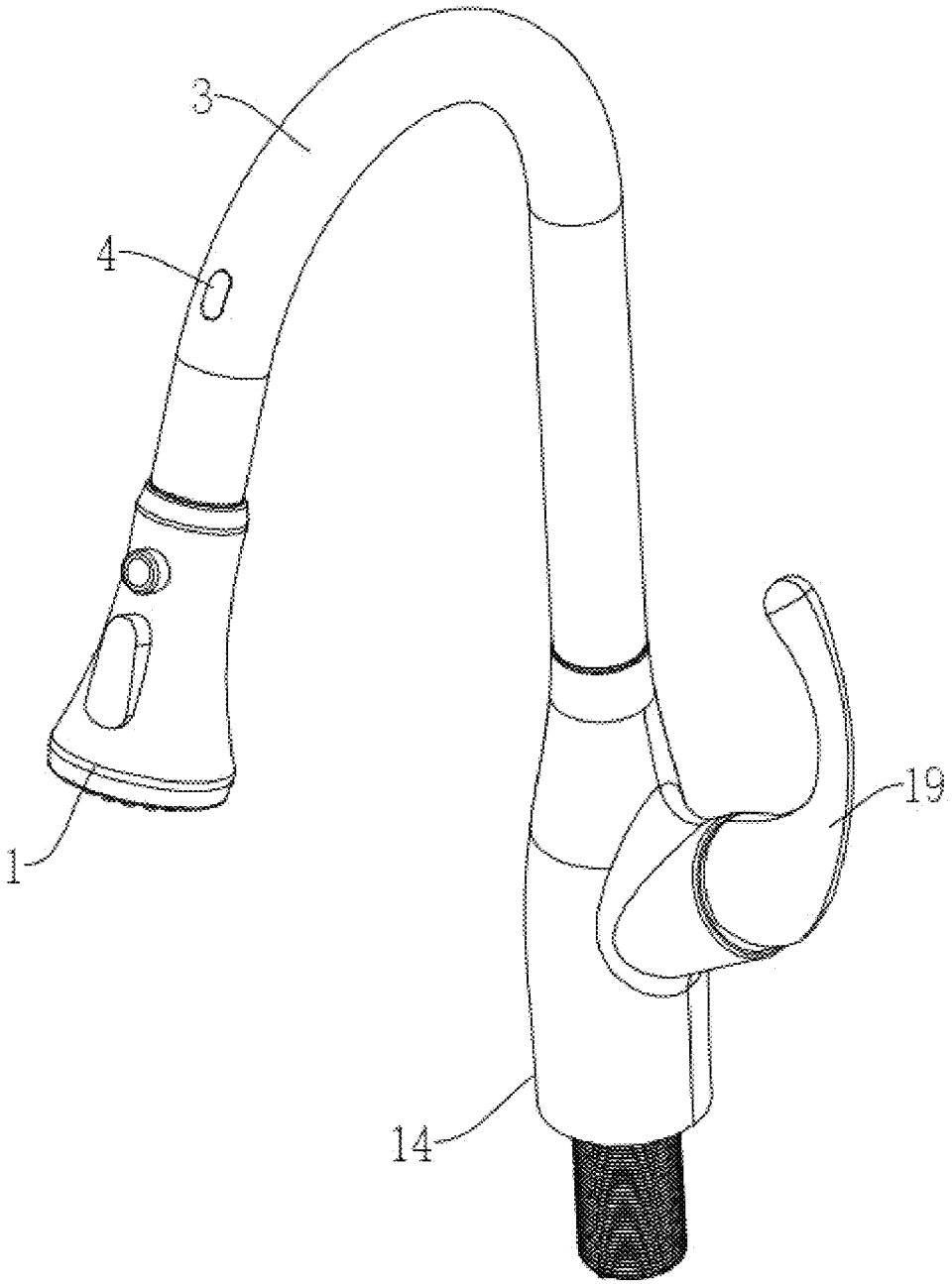
FIG. 1 is an overall structural diagram of the anti-winding pull-out sensor faucet provided by the invention.
Figure 2:
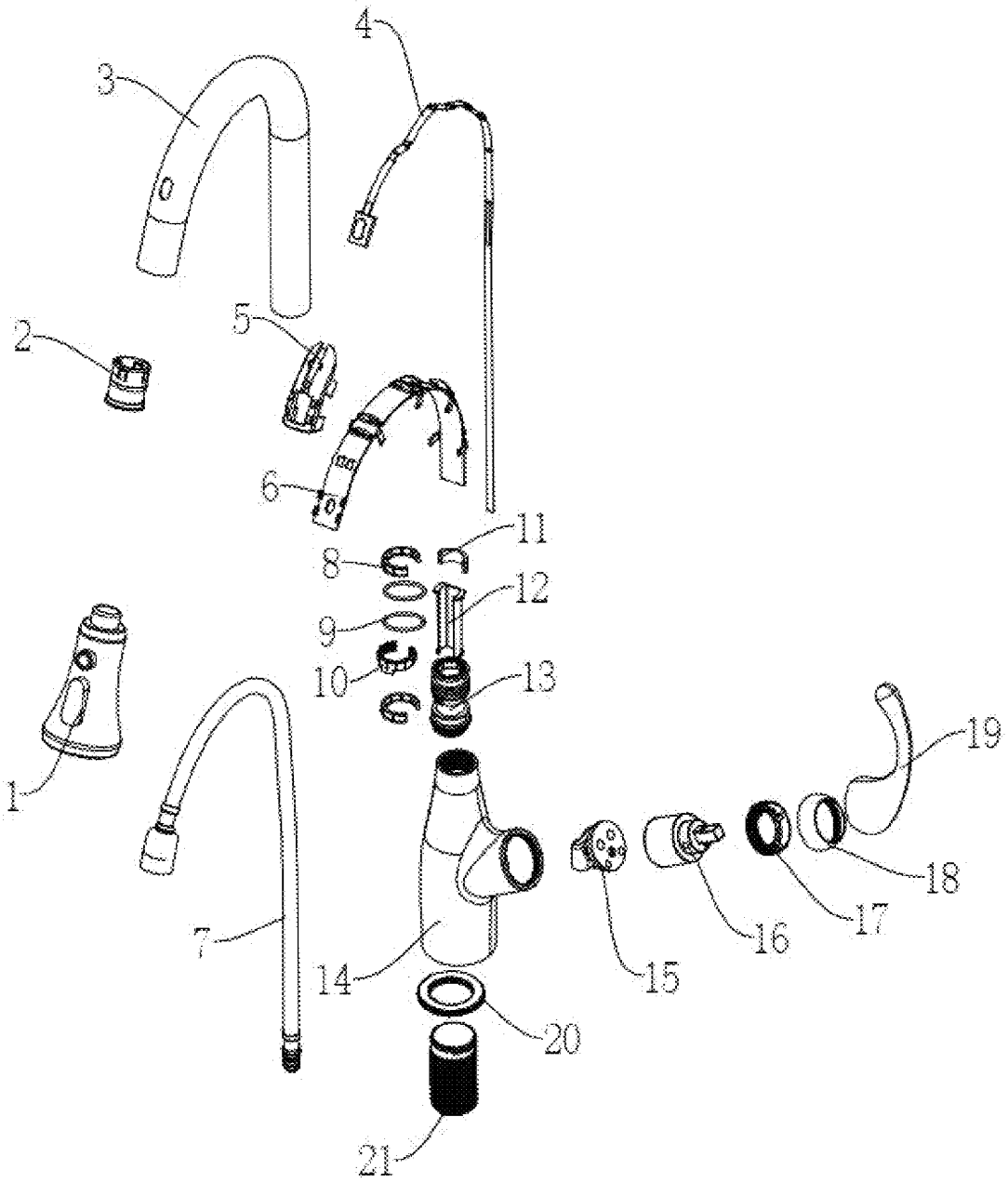
FIG. 2 is an exploded view of the anti-winding pull-out sensor faucet provided by the invention.
Figure 3:
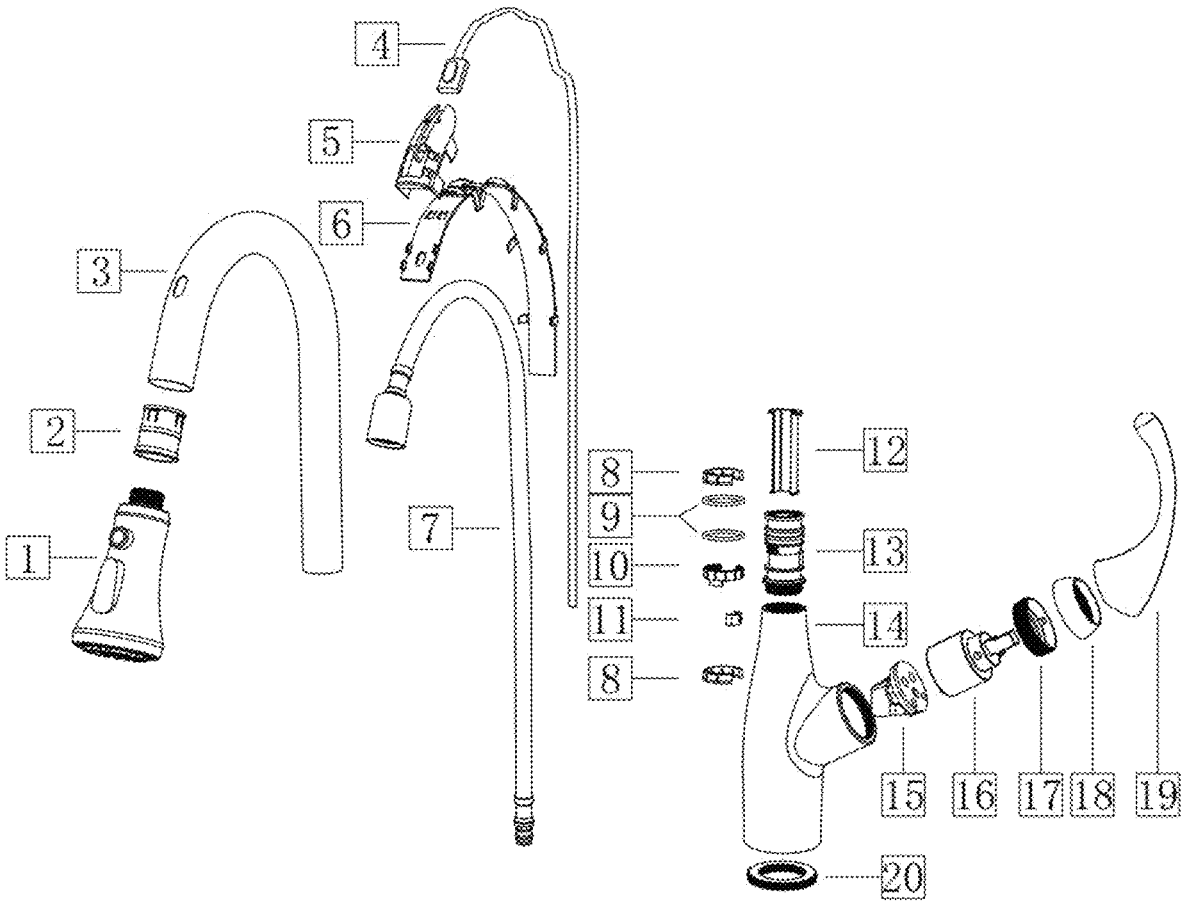
FIG. 3 is a diagram illustrating installation of the embodiment.

As shown in FIG. 1, FIG. 2 and FIG. 3, the invention provides an anti-winding pull-out sensor faucet, comprising a main body 14, a plastic connection joint 13 and a swinging elbow pipe 3; the plastic connection joint 13 is threadedly connected to an upper end of the main body 14, the swinging elbow pipe 3 is in plug-in connection with the plastic connection joint 13 and is provided above the main body 14, a pipe separator 12 is provided in plug-in connection with an upper end of the plastic connection joint 13, a port of the swinging elbow pipe 3 is in plug-in connection with a pull-out sprayer cartridge 2, and the pull-out sprayer cartridge 2 is in plug-in connection with a hand sprayer 1; one end of the hand sprayer 1 located within the pull-out sprayer cartridge 2 is connected to a pull-out hose 7, and an other end of the pull-out hose 7 is set throughout the pipe separator 12 along an inner wall of the swinging elbow pipe 3; in the swinging elbow pipe 3 is provided with a wire clamp 6 and the wire clamp 6 is provided above the pull-out hose 7; the wire clamp 6 is in plug-in connection with an inductor limiter 5, the inductor limiter 5 is in plug-in connection with an inductor 4, and an upper end of the inductor 4 is set through the swinging elbow pipe 3, an other end of the inductor 4 passes over a top of the wire clamp 6 and between an inner wall of the swinging elbow pipe 3 and is set running through the pipe separator 12.

In order to realize rotation limit of the swinging elbow pipe 3, the plastic connection joint 13 is in plug-in connection with anti-swing snap rings 8, side wall of the plastic connection joint 13 is sleeved with O-rings 9, and the wire clamp 6 is set in grooves on side wall of the pipe separator 12 between two sets of anti-swing snap rings 8, a side wall of the plastic connection joint 13 is provided with a plurality of wavelike projections, the side wall of the plastic connection joint 13 is in plug-in connection with a limiting snap ring 10, and the limiting snap ring 10 is snap-fitted with the projections on the side wall of the plastic connection joint 13; a swinging snap ring 11 is snap-fitted with side wall at a rear end of the plastic connection joint 13.

In order to realize manual control on/off of water flow, a valve core seat 15 is provided at an outlet at a side end of the main body 14, the outlet at the side end of the main body 14 is in plug-in connection with a valve core 16, and the valve core 16 is aligned and connected with the valve core seat 15; the outlet at the side end of the main body 14 is threadedly connected with a gland 17, and the gland 17 is threadedly connected with a decorative cover 18; the decorative cover 18 is rotatably connected with a handle 19, and a control end on the valve core 16 is in plug-in connection with the handle 19.

In order to realize installation and fixing of the faucet, a bottom of the main body 14 is in plug-in connection with a foundation ring 20, the bottom of the main body 14 is threadedly connected with a double-ended screw tube 21, and the double-ended screw tube 21 is set through the foundation ring 20.

The pipe separator 12 and wire clamp 6 are both set between the pull-out hose 7 and the inductor 4, the swinging snap ring 11 is set between the plastic connection joint 13 and an inner wall of the swinging elbow pipe 3, and the inductor limiter 5 is set between the wire clamp 6 and the inner wall of the swinging elbow pipe 3.

The anti-swinging snap ring 8 is set in a C-shape, the pipe separator 12 is set in a U-shaped piece with two curved sides, and the swinging snap ring 11 is set in a curved plate shape.

In specific use, the pull-out hose 7 and wiring harness of inductor 4 are separated via the wire clamp 6 and pipe separator 12 fixed in the swinging elbow pipe 3, and at the same time, the inductor 4 is assembled with the wire clamp 6 via the inductor limiter 5 and are fixed in the pull-out sprayer cartridge 2, and induction window of the inductor 4 fixedly passes through an upper end of the pull-out sprayer cartridge 2; the inductor 4 is utilized for inductively controlling a switch of the water flow, and the wire clamp 6 is used to guide the pull-out hose 7 and the wiring harness of inductor 4 when it is needed to pull the hand sprayer 1, and to keep the two being separated, to prevent them from winding together, the above is the entire using process of the anti-winding pull-out sensor faucet.

The invention and its embodiments have been described above, but the description is not limited thereto; only one embodiment of the invention is shown in the drawings, and the actual structure is not limited thereto. In general, it is to be understood by those skilled in the art that non-creative design of structural forms and embodiments that are similar to the technical solutions without departing from the spirit of the invention shall all fall within the protective scope of the invention.

What is claimed is:

1. An anti-winding pull-out sensor faucet, comprising a main body, a plastic connection joint and a swinging elbow pipe; the plastic connection joint is threadedly connected to an upper end of the main body, the swinging elbow pipe is in plug-in connection with the plastic connection joint and is provided above the main body, a pipe separator is provided in plug-in connection with an upper end of the plastic connection joint, a port of the swinging elbow pipe is in plug-in connection with a pull-out sprayer cartridge, and the pull-out sprayer cartridge is in plug-in connection with a hand sprayer; one end of the hand sprayer located within the pull-out sprayer cartridge is connected to a pull-out hose, and an other end of the pull-out hose is set throughout the pipe separator along an inner wall of the swinging elbow pipe; in the swinging elbow pipe is provided with a wire clamp and the wire clamp is provided above the pull-out hose; the wire clamp is in plug-in connection with an inductor limiter, the inductor limiter is in plug-in connection with an inductor, and an upper end of the inductor is set through the swinging elbow pipe, an other end of the inductor passes over a top of the wire clamp and between an inner wall of the swinging elbow pipe and is set running through the pipe separator;

wherein the plastic connection joint is in plug-in connection with anti-swing snap rings, side wall of the plastic connection joint is sleeved with O-rings, and the wire clamp is set in grooves on side wall of the pipe separator between two sets of anti-swing snap rings, a side wall of the plastic connection joint is provided with a plurality of wavelike projections, the side wall of the plastic connection joint is in plug-in connection with a limiting snap ring and the limiting snap ring is snap-fitted with the projections on the side wall of the plastic connection joint; a swinging snap ring is snap-fitted with side wall at a rear end of the plastic connection joint.

2. The anti-winding pull-out sensor faucet of claim 1, wherein a valve core seat is provided at an outlet at a side end of the main body, the outlet at the side end of the main body is in plug-in connection with a valve core, and the valve core is aligned and connected with the valve core seat; the outlet at the side end of the main body is threadedly connected with a gland, and the gland is threadedly connected with a decorative cover; the decorative cover is rotatably connected with a handle, and a control end on the valve core is in plug-in connection with the handle.

3. The anti-winding pull-out sensor faucet of claim 2, wherein a bottom of the main body is in plug-in connection with a foundation ring, the bottom of the main body is threadedly connected with a double-ended screw tube, and the double-ended screw tube is set through the foundation ring.

4. The anti-winding pull-out sensor faucet of claim 3, wherein the pipe separator and wire clamp are both set between the pull-out hose and the inductor, the swinging snap ring is set between the plastic connection joint and an inner wall of the swinging elbow pipe, and the inductor limiter is set between the wire clamp and the inner wall of the swinging elbow pipe.

5. The anti-winding pull-out sensor faucet of claim 4, wherein the anti-swinging snap ring is set in a C-shape, the pipe separator is set in a U-shaped piece with two curved sides, and the swinging snap ring is set in a curved plate shape.

* * * * *